US008763947B2

(12) United States Patent
Keily et al.

(10) Patent No.: US 8,763,947 B2
(45) Date of Patent: Jul. 1, 2014

(54) COVER ACTUATED ROLL TOWEL DISPENSE

(75) Inventors: Joel P. Keily, Corona, CA (US); Alexander Trampolski, Richmond (CA)

(73) Assignee: Dispensing Dynamics International, City of Industry, CA (US)

( * ) Notice: Subject to any disclaimer, the term of this patent is extended or adjusted under 35 U.S.C. 154(b) by 591 days.

(21) Appl. No.: 13/066,904

(22) Filed: Apr. 27, 2011

(65) Prior Publication Data

US 2012/0273605 A1 Nov. 1, 2012

(51) Int. Cl.
*B65H 49/34* (2006.01)

(52) U.S. Cl.
USPC ..... 242/564.2; 242/565

(58) Field of Classification Search
USPC ..... 242/564, 564.1, 564.2, 564.3, 564.4, 242/565, 596, 596.8
See application file for complete search history.

(56) References Cited

U.S. PATENT DOCUMENTS

| | | | | |
|---|---|---|---|---|
| 2,149,088 | A | 2/1939 | Grunwald | |
| 2,919,842 | A | 1/1960 | Batlas | |
| 2,930,664 | A | 3/1960 | Liebisch | |
| 2,974,839 | A | 3/1961 | Batlas et al. | |
| 3,007,650 | A | 11/1961 | Burton | |
| 3,126,234 | A | 3/1964 | Batlas et al. | |
| 3,288,387 | A | 11/1966 | Craven, Jr. | |
| 3,297,269 | A * | 1/1967 | McGrew | 242/564.4 |
| 3,301,617 | A * | 1/1967 | Goodwin et al. | 242/564.4 |
| 3,466,963 | A | 9/1969 | Palson et al. | |
| 3,628,743 | A | 12/1971 | Bastian | |
| 3,843,218 | A | 10/1974 | Krueger et al. | |
| 3,917,191 | A | 11/1975 | Graham, Jr. | |
| 4,067,509 | A | 1/1978 | Graham, Jr. | |
| 4,086,833 | A | 5/1978 | Austin, Jr. | |
| 4,165,138 | A | 8/1979 | Hedge et al. | |
| 4,192,442 | A | 3/1980 | Bastian et al. | |
| 4,203,562 | A | 5/1980 | DeLuca et al. | |
| 4,236,679 | A | 12/1980 | Jespersen | |
| 4,317,547 | A | 3/1982 | Graham, Jr. | |
| 4,358,169 | A | 11/1982 | Filipowicz | |
| 4,378,912 | A | 4/1983 | Perrin et al. | |
| 4,396,163 | A | 8/1983 | Graham, Jr. | |
| 4,403,748 | A | 9/1983 | Cornell | |
| 4,406,421 | A | 9/1983 | Schultz et al. | |
| 4,611,768 | A | 9/1986 | Voss et al. | |
| 4,756,485 | A | 7/1988 | Bastian et al. | |
| 4,846,412 | A | 7/1989 | Morand | |
| 4,856,724 | A | 8/1989 | Jespersen | |
| 5,125,548 | A | 6/1992 | Perrin et al. | |
| 5,294,192 | A | 3/1994 | Omdoll et al. | |
| 5,400,982 | A | 3/1995 | Collins | |
| 5,526,973 | A | 6/1996 | Boone et al. | |
| 6,032,898 | A | 3/2000 | LaCount et al. | |
| 8,177,156 | B1 * | 5/2012 | Rinne | 242/564.4 |
| 2010/0219282 | A1 * | 9/2010 | Troutman et al. | 242/564.4 |

FOREIGN PATENT DOCUMENTS

| | | |
|---|---|---|
| CA | 2060799 | 8/1992 |

* cited by examiner

*Primary Examiner* — William A Rivera
(74) *Attorney, Agent, or Firm* — Thomas R. Lampe

(57) ABSTRACT

Toweling dispenser apparatus includes a cover having relatively moveable cover portions. Relative movement caused by pushing one of the cover portions operates through transmission structure to rotate a toweling support drum and move toweling within the interior of the apparatus toward a dispensing position.

10 Claims, 4 Drawing Sheets

COVER ACTUATED ROLL TOWEL DISPENSE

TECHNICAL FIELD

This invention relates to apparatus for dispensing paper toweling from a roll of paper toweling.

BACKGROUND OF THE INVENTION

It is known to utilize push bars not part of cabinet structure of a paper towel dispenser to actuate mechanism within the cabinet to cause dispensing. Typically, this mechanism includes a toweling transport drum or roller which causes unwinding of a roll of toweling and delivers the tail of the toweling toward a dispensing position, for example alongside a cutting blade of the dispenser.

U.S. Pat. No. 6,032,898, issued Mar. 7, 2000, is one example of such an arrangement. The roll towel dispenser disclosed in that patent teaches use of actuator means in the form of a push bar utilized to rotate a drive roller causing paper in contact therewith to be unwound from a paper roll and dispensed through a dispensing outlet. The push bar is not part of the cabinet which includes a housing and housing cover but rather is pivotally mounted on the housing, extending outwardly of the housing below the bottom thereof. A single arcuate gear segment is attached to the push bar to apply a force at one end of the drive roller for rotating the drive roller.

Other patent documents considered representative of the current state of the prior art are: U.S. Pat. No. 2,149,088, issued February, 1939, U.S. Pat. No. 2,919,842, issued January, 1960, U.S. Pat. No. 2,930,664, issued March, 1960, U.S. Pat. No. 2,974,839, issued March, 1961, U.S. Pat. No. 3,007,650, issued November, 1961, U.S. Pat. No. 3,126,234, issued March, 1964, U.S. Pat. No. 3,288,387, issued November, 1966, U.S. Pat. No. 3,466,963, issued September, 1969, U.S. Pat. No. 3,628,743, issued December, 1971, U.S. Pat. No. 3,843,218, issued October, 1974, U.S. Pat. No. 3,917,191, issued November, 1975, U.S. Pat. No. 4,067,509, issued January, 1978, U.S. Pat. No. 4,086,833, issued May, 1978, U.S. Pat. No. 4,165,138, issued August, 1979, U.S. Pat. No. 4,192,442, issued March, 1980, U.S. Pat. No. 4,203,562, issued May, 1980, U.S. Pat. No. 4,236,679, issued December, 1980, U.S. Pat. No. 4,317,547, issued March, 1982, U.S. Pat. No. 4,358,169, issued November, 1982, U.S. Pat. No. 4,378,912, issued April, 1983, U.S. Pat. No. 4,396,163, issued August, 1983, U.S. Pat. No. 4,403,748, issued September, 1983, U.S. Pat. No. 4,406,421, issued September, 1983, U.S. Pat. No. 4,611,768, issued September, 1986, U.S. Pat. No. 4,756,485, issued July, 1988, U.S. Pat. No. 4,846,412, issued July, 1989, U.S. Pat. No. 4,856,724, issued August, 1989, U.S. Pat. No. 5,125,548, issued June, 1992, U.S. Pat. No. 5,294,192, issued March, 1994, U.S. Pat. No. 5,400,982, issued March, 1995, U.S. Pat. No. 5,526,973, issued June, 1996 and Canadian Patent No. 2060799, issued August, 1992.

DISCLOSURE OF INVENTION

The present invention relates to apparatus for dispensing paper toweling from a roll of paper toweling which utilizes the cover of a dispensing cabinet employed to cover the dispenser housing thereof to cause dispensing of paper toweling maintained within the housing.

The structure disclosed herein is characterized by its relative simplicity, ease and convenience of use, and relatively low cost as compared to dispensers which employ actuator mechanisms separate from the cabinet.

The arrangement disclosed and claimed herein provides a wide and relatively large surface which can be readily engaged by a person's hand, arm, elbow, etc. to cause dispensing. In addition, the large surface is more hygienic than separate, relatively small, actuator bars, push buttons, handles and the like. By giving the user a large target to push, the user can avoid having to touch a place where a previous user has left a wet spot.

By employing the cover to operate the dispensing mechanism a material such as polypropylene, often used to construct dispensing cabinets because of the ability to bead and shed water, can be utilized. Polypropylene is hydrophobic.

Another important attribute of the invention disclosed and claimed herein is the use of a dual rack drive system in association with the wide portion cover, thus ensuring that the transport roller can be driven at two ends, providing stability and reliable operation regardless of where contact is made with the cover portion operatively associated with the dispensing mechanism.

The apparatus for dispensing paper toweling from a roll of paper toweling of the present invention includes a dispenser housing defining a housing interior and an opening communicating with the housing interior permitting access to the housing interior.

A rotatable, elongated toweling support drum is provided for receiving and supporting paper toweling extending from a roll of paper toweling in the housing interior and transporting the paper toweling to dispense the paper toweling.

The apparatus also includes a cover having a first cover portion and a second cover portion. The cover is mounted for movement relative to the housing and selectively movable relative thereto between a first position wherein the opening is enclosed by the first and second cover portions and a second position wherein the opening is uncovered.

Transmission structure is operatively associated with the cover and the toweling support drum and is responsive to movement of the first cover portion relative to the second cover portion when the cover is in the first position to rotate the toweling support drum.

Other features, advantages and objects of the present invention will become apparent with reference to the following description and accompanying drawings.

BEST MODE FOR CARRYING OUT THE INVENTION

Figure 2:
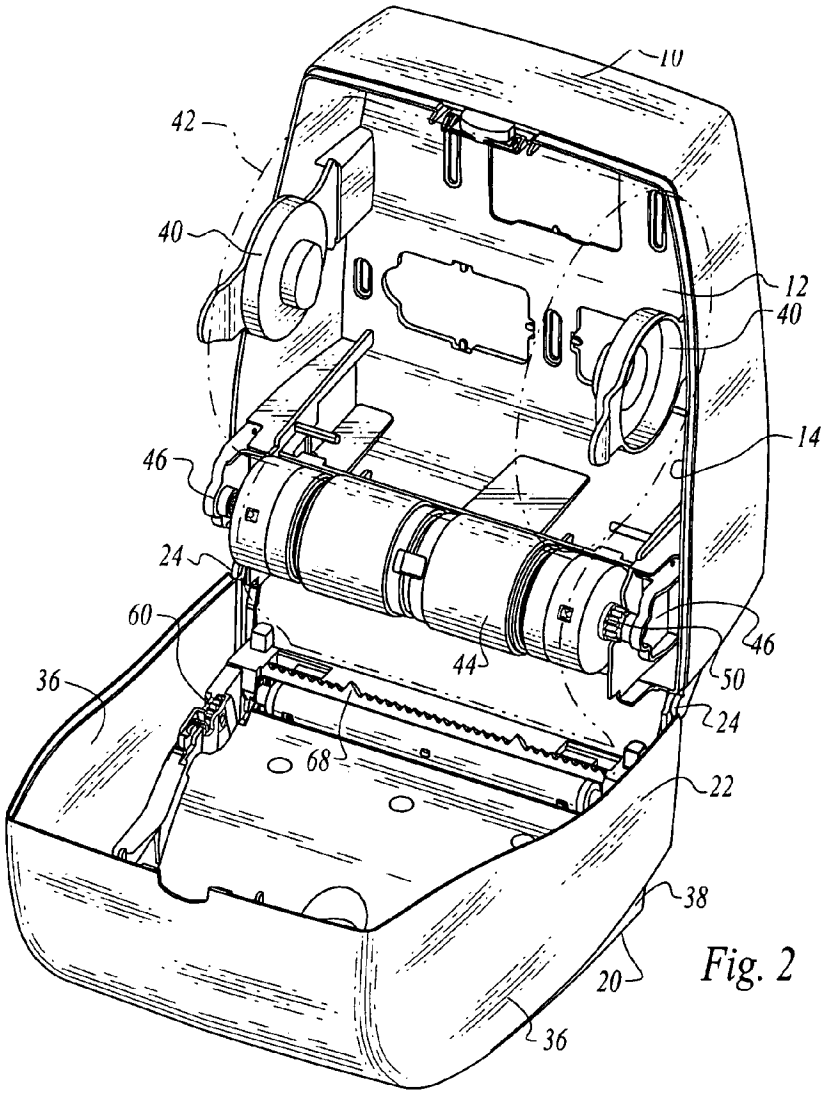
FIG. 2 is a perspective view illustrating the cabinet cover open relative to the cabinet housing, internal components of the apparatus being illustrated.

Referring now to the drawings, apparatus constructed in accordance with the teachings of the present invention includes a dispenser housing 10 defining a housing interior 12 and an opening 14 communicating with the housing interior and permitting access to the housing interior for paper toweling roll replenishment and other purposes.

Figure 1:
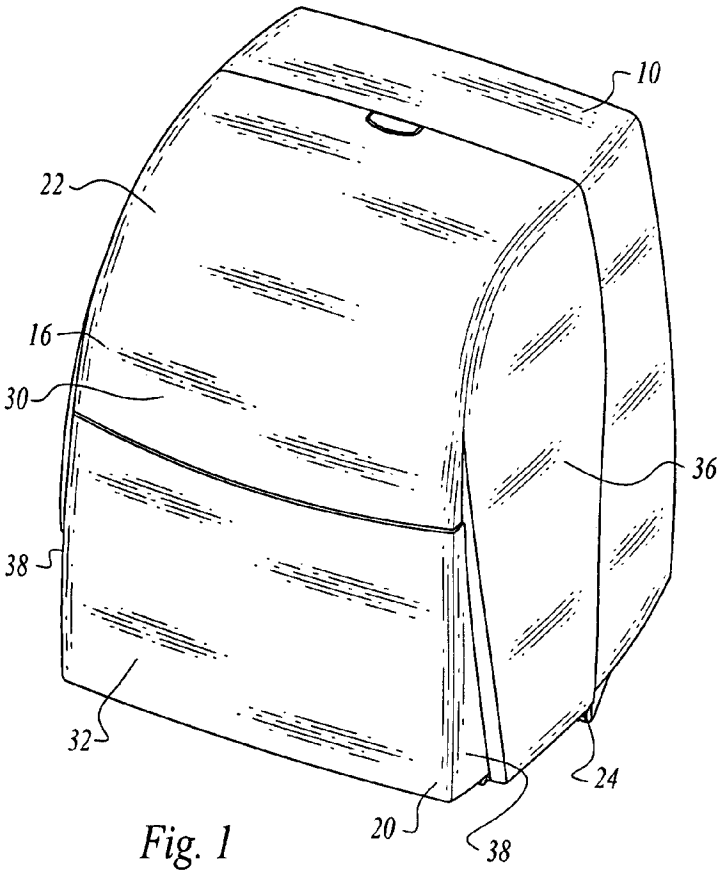
FIG. 1 is a frontal, perspective view of apparatus constructed in accordance with the teachings of the present invention and more particularly the apparatus cabinet including a housing and cover which are shown in closed, operative condition.

A cover 16 is hingedly connected to the housing and may be selectively pivoted between a position, shown for example in FIG. 1, wherein the opening 14 is closed by the cover and a second position, shown in FIG. 2, wherein the opening is uncovered.

The cover 16 includes a cover portion 20 and a cover portion 22. When the cover is closed, the cover portions 20, 22 jointly close the opening 14. The cover comprising the cover portions is hingedly connected at the bottoms of the housing and cover. More particularly, the hinge connection is designated by reference numeral 24 between cover portion 22 and the housing.

Cover portion 22 includes a front panel 30 and cover portion 20 has a front panel 32. The front panels of the cover portions are pivotally connected by hinge structure 34. Cover portion 20 is located below cover portion 22 and is supported by cover portion 22.

Cover portion 22 includes opposed side panels 36 attached to the front panel 30. Cover portion 20 includes side panels 38 attached to the front panel 32 thereof. The side panels of cover portion 20 are disposed inwardly of and alongside the side panels 36 of cover portion 22. This structure contributes to the stability of cover portion 20 when it is pushed inwardly in a manner to be described below.

Roll holders 40 are attached to housing 10 for rotatably supporting a roll of paper toweling 42. Located below the roll of paper toweling is rotatable, elongated toweling support drum or roller 44. Stub shafts extending outwardly from the ends of the toweling support drum are rotatably positioned in support brackets 46 attached to the housing. Gears 50 are affixed to the stub shafts and attached to the toweling support drum by the stub shafts. The gears 50 comprise portions of the transmission structure of the apparatus operatively associated with the cover and the toweling support drum and responsive to movement of the cover portion 20 relative to the cover portion 22 when the cover is closed to rotate the toweling support drum.

Other components of the transmission structure are two toothed rack members 56 attached to the front panel 20, the rack members having a slightly curved configuration. These rack members are disposed on opposite sides of the cover within the interior thereof.

Figure 4:
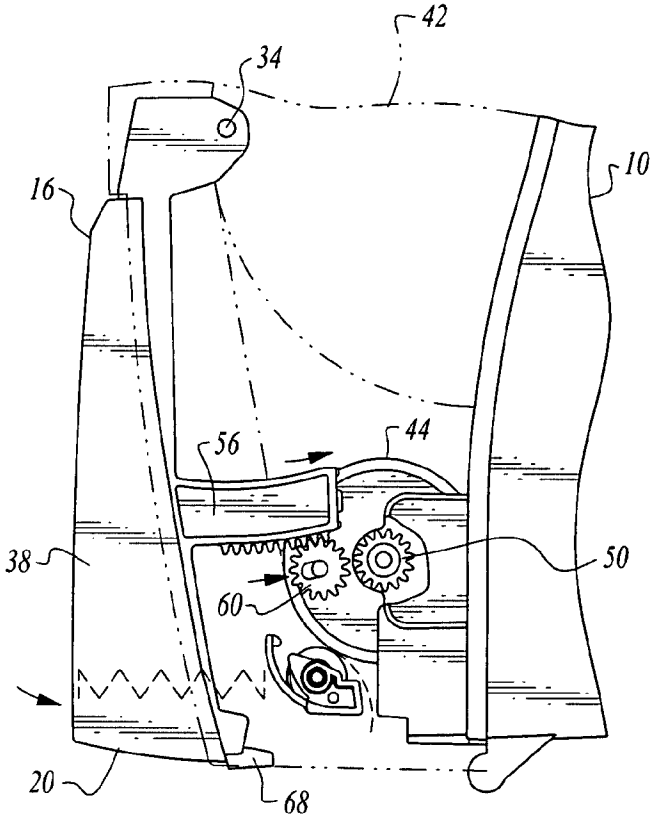
FIG. 4 is a schematic, side elevational view illustrating the condition of selected components of the invention just prior to the cover portion being pushed to actuate the dispensing mechanism.
Figure 3:
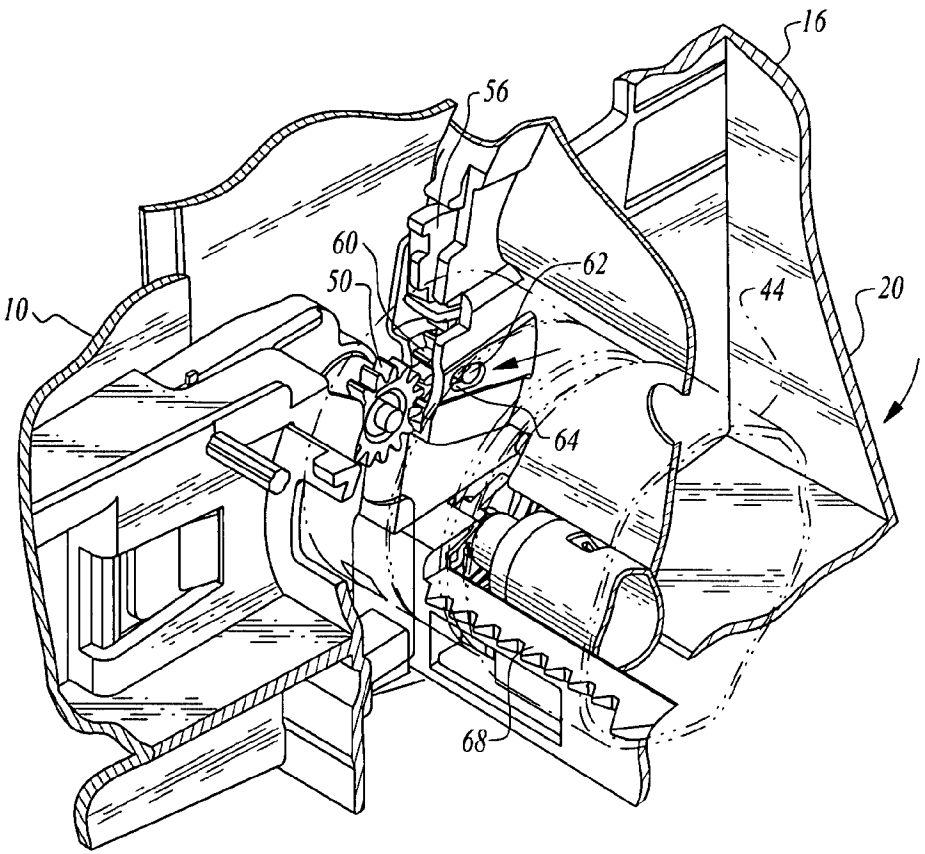
FIG. 3 is a greatly enlarged, perspective view in partial cross-section as viewed from the side rear of the apparatus illustrating selected internal components of the apparatus when the housing and cover are in the closed, operative condition shown in FIG. 1 illustrating a cover portion just prior to being pushed to actuate the dispenser mechanism.

Rotatably mounted on the cover portion and projecting inwardly from the side panels 38 thereof are floating gears 60 which are in alignment with gears 50 on the toweling support drum 44. Stub shafts 62 projecting from the sides of the gears 60 project into slots 64 formed in structure at the side panels 38. As may be seen with reference to the drawings, the slots are slightly inclined downwardly in the direction of the cover portion 20. The force of gravity, in the absence of an outside force being exerted on the floating gears, will cause the floating gears to remain out of engagement with gears 50 of the toweling support drum even when the cover is closed. This is shown for example in FIGS. 3 and 4.

Figure 6:
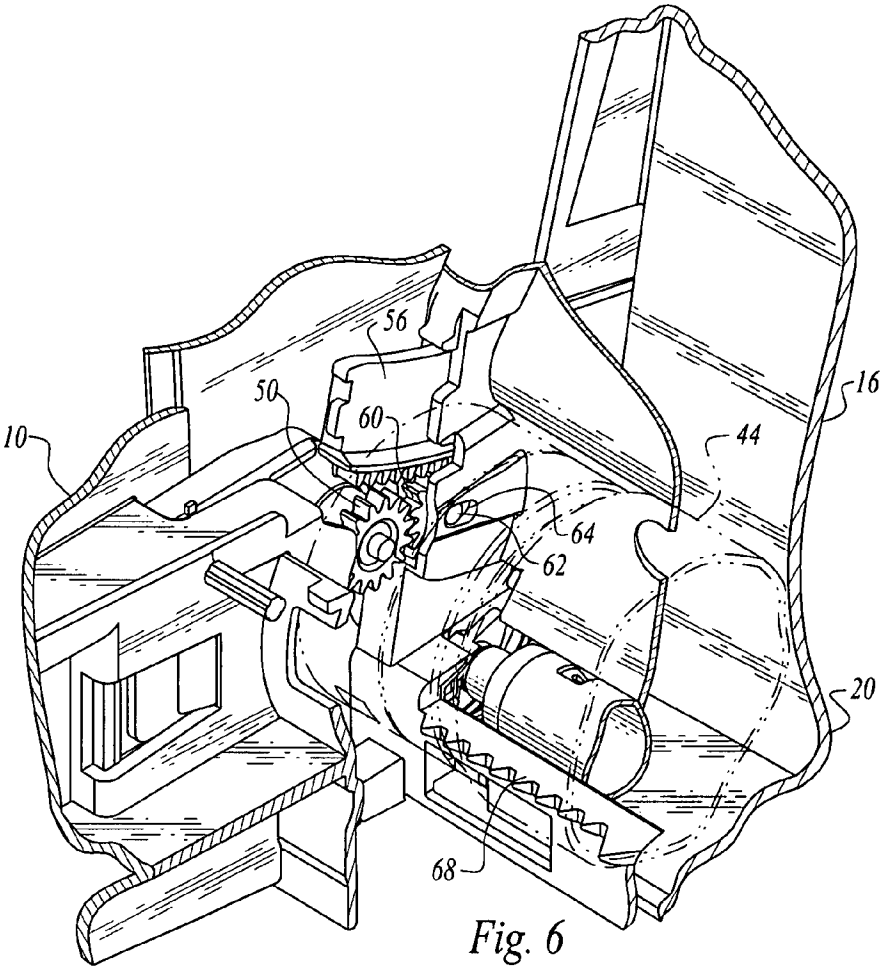
FIG. 6 is a view similar to FIG. 3 and illustrating the same components, but showing the operative positions of the components after the cover portion has been pushed.
Figure 5:
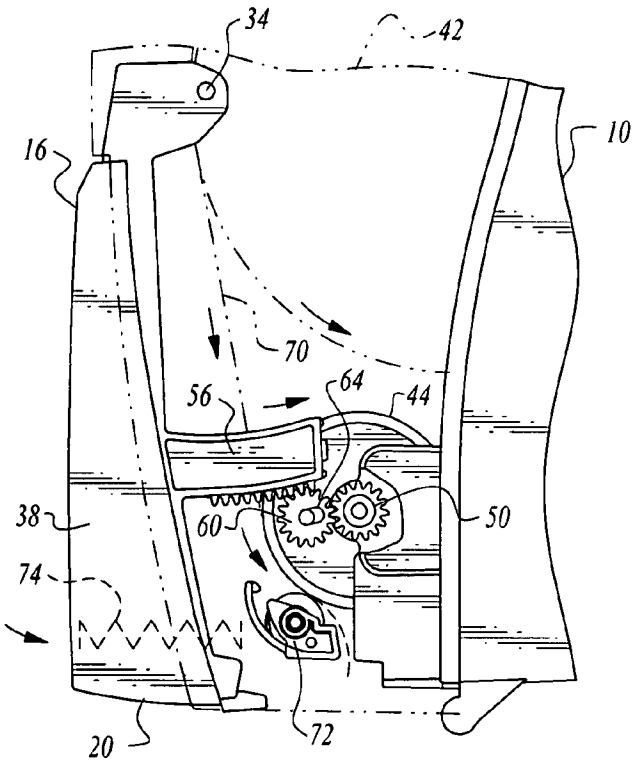
FIG. 5 is a view similar to FIG. 4, but illustrating the condition of the components as the cover portion is being pushed inwardly.
Figure 9:
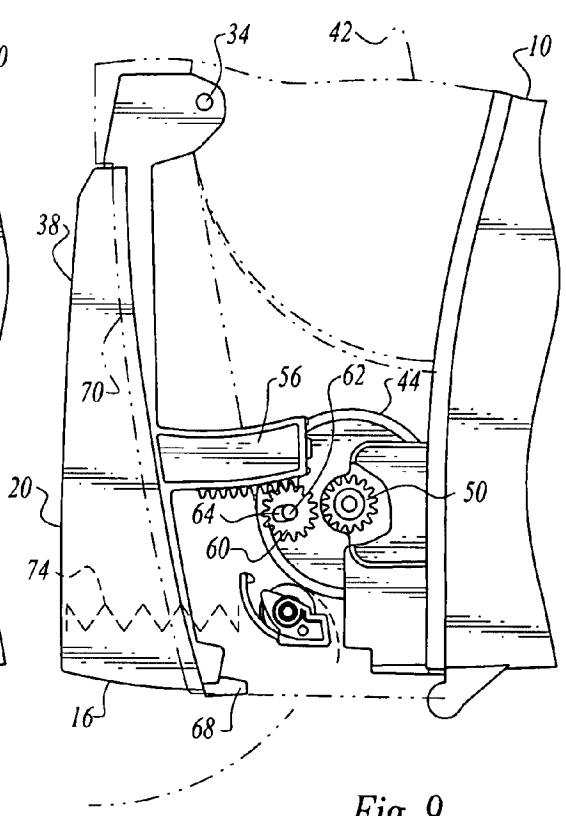
FIGS. 7-9 are views similar to FIGS. 4 and 5, but indicating the condition of the illustrated components during sequential stages after dispensing has taken place and the cover portion is no longer being pushed by a user.

When, however, a pushing force is exerted on the front panel of the cover portion 20, the rack members 56 will also move inwardly and cause the floating gears to engage gears 50. This is shown in FIGS. 5 and 6. Once engagement takes place between the floating gears and the gears of the toweling support drum, continued pushing of the cover portion 50 and inward movement of the rack members will cause rotation of the toweling support drum 44, as shown in FIG. 5, causing the free end of the paper toweling to be moved into dispensing position adjacent a cutter blade 68 and consequent rotation of the roll of paper toweling. In the arrangement illustrated, the toweling 70 passes between the toweling support drum and a nip roller 72.

Figure 8:
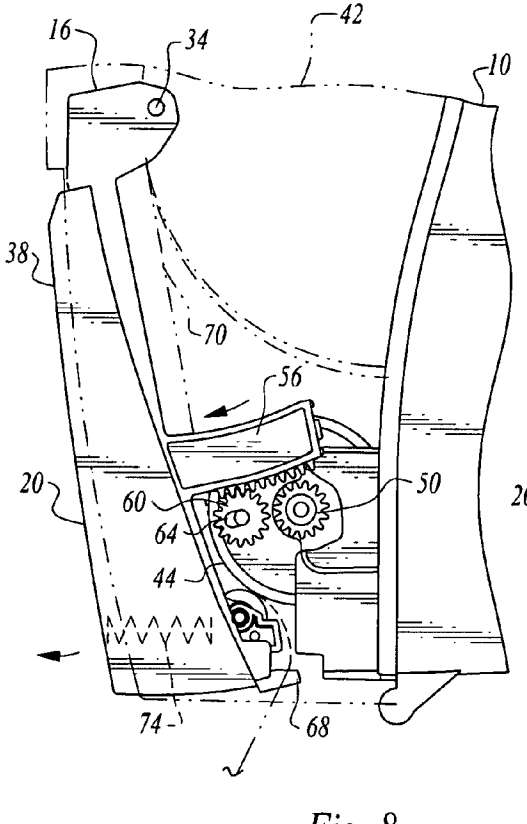
Figure 7:
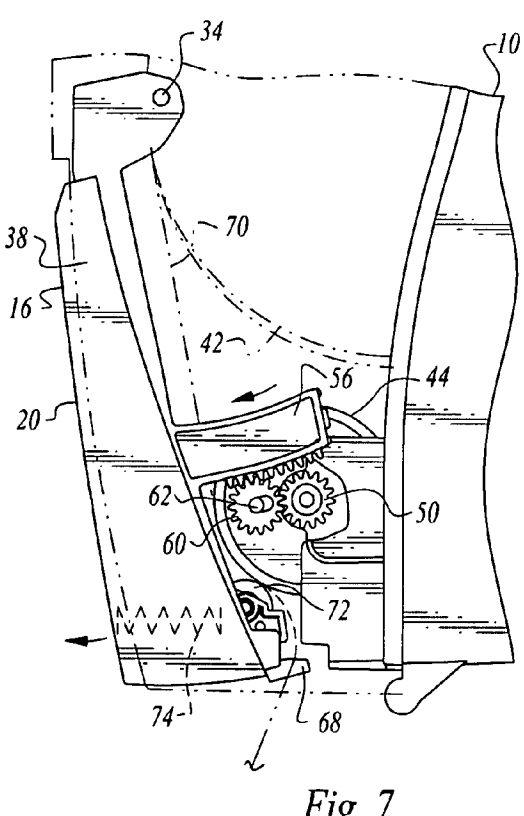

When pushing forces are removed, one or more springs 74 biasing the cover portion 20 in a direction away from the dispenser housing will cause outward movement of the cover portion 20 and the rack members 56. This will cause the floating gears to move back to their initial positions as shown in FIG. 8 so that the floating gears are disengaged from gears 50. The user separates the tail end of the toweling from the remainder thereof by pulling the toweling toward the cutter blade 68 on the cover portion 20.

By using the floating gears, a user can push on either side of the cover portion 20 without binding the gear train. Also, the floating gear construction avoids having to use a one-way clutch or one-way bearing system.

The invention claimed is:

1. Apparatus for dispensing paper toweling from a roll of paper toweling, said apparatus comprising, in combination:

a dispenser housing defining a housing interior and an opening communicating with said housing interior permitting access to said housing interior;

a rotatable, elongated toweling support drum for receiving and supporting paper toweling extending from a roll of paper toweling in said housing interior and for transporting said paper toweling to dispense the paper toweling;

a cover including a first cover portion and a second cover portion, said first cover portion moveable relative to said second cover portion, said cover mounted for movement relative to said housing and selectively movable relative thereto between a closed position wherein said opening is closed by said first and second cover portions and an open position wherein said opening is uncovered; and transmission structure operatively associated with said cover and said toweling support drum and responsive to movement of said first cover portion relative to said second cover portion when said cover covers said opening to rotate said toweling support drum, said transmission structure including a toothed rack member attached to said first cover portion and extending inwardly therefrom into said housing interior when said cover is in said closed position and a floating gear rotatably mounted on said cover in engagement with said toothed rack member, said toweling support drum having a gear attached thereto, said floating gear moveable between a first position wherein said floating gear is not in engagement with the gear attached to said toweling support drum and a second position wherein said floating gear engages the gear attached to said toweling support drum, said floating gear biased by the force of gravity toward said first position, inward movement of said first cover portion and inward movement of said toothed rack member when the cover is in said closed position moving the floating gear from said first position to said second position and further inward movement of said first cover portion and said toothed rack member after said floating gear engages the gear attached to said toweling support drum causing rotation of said toweling support drum.

2. The apparatus according to claim 1 wherein each of said first and second cover portions includes a front panel, said front panels of said first and second cover portions being pivotally connected.

3. The apparatus according to claim 2 wherein said first cover portion is located below said second cover portion and is supported by said second cover portion.

4. The apparatus according to claim 3 wherein each of said first and second cover portions includes side panels attached to the front panel thereof, the side panels of said first cover portion disposed inwardly of and alongside the side panels of said second cover portion.

5. The apparatus according to claim 1 additionally comprising at least one spring for biasing said first cover portion in a direction away from said dispenser housing when the cover is in said first position.

6. The apparatus according to claim 1 wherein said transmission means includes two toothed rack members attached to the first cover portion and extending inwardly therefrom into said housing interior when said cover is in said closed position, said transmission means including two floating gears rotatably mounted on said cover in engagement with said toothed rack members, said toweling support drum having gears attached at opposed ends thereof in operative engagement with the floating gears rotatably mounted on said cover when said cover in said closed position whereby inward movement of said first cover portion rotates both of said floating gears and the gears attached to the opposed ends of the toweling support drum to effect rotation of said toweling support drum.

7. The apparatus according to claim 1 additionally comprising a nip roller forming a nip with said toweling support drum through which the paper toweling passes during dispensing thereof.

8. The apparatus according to claim 1 wherein said toothed rack member is curved and in continuous engagement with said floating gear during movement of said first cover portion relative to said second cover portion.

9. The apparatus according to claim 1 wherein said cover defines an inclined slot, said floating gear mounted for movement along said slot between said first position and said second position.

10. The apparatus according to claim 1 wherein said floating gear is aligned with the gear attached to the toweling support drum.

* * * * *